US009006619B2

(12) United States Patent
McNamee et al.

(10) Patent No.: US 9,006,619 B2
(45) Date of Patent: Apr. 14, 2015

(54) COOKING APPLIANCE INCLUDING COMBINATION HEATING SYSTEM

(75) Inventors: Robert McNamee, Iowa City, IA (US); Robert A. Schulte, Williamsburg, IA (US); Thomas Miller, Kalona, IA (US); Roger W. Carlson, Cedar Rapids, IA (US); James A. Goranson, Williamsburg, IA (US); Edward R. Cook, Cedar Rapids, IA (US)

(73) Assignee: ACP, Inc., Cedar Rapids, IA (US)

( * ) Notice: Subject to any disclaimer, the term of this patent is extended or adjusted under 35 U.S.C. 154(b) by 1953 days.

(21) Appl. No.: 12/248,681

(22) Filed: Oct. 9, 2008

(65) Prior Publication Data

US 2009/0095738 A1 Apr. 16, 2009

Related U.S. Application Data

(60) Provisional application No. 60/960,660, filed on Oct. 9, 2007.

(51) Int. Cl.

| | |
|---|---|
| ***H05B 3/34*** | (2006.01) |
| ***H05B 3/54*** | (2006.01) |
| ***F27D 11/00*** | (2006.01) |
| ***H05B 6/64*** | (2006.01) |

(52) U.S. Cl.

CPC ..... *H05B 6/6485* (2013.01)

(58) Field of Classification Search

USPC ..... 219/678–685, 690–691, 702, 715, 219/391–393, 395, 396, 398, 400, 417

See application file for complete search history.

(56) References Cited

U.S. PATENT DOCUMENTS

| | | | | |
|---|---|---|---|---|
| 2,862,095 | A | 11/1958 | Scofield | |
| 4,283,614 | A | 8/1981 | Tanaka et al. | |
| 4,332,992 | A | 6/1982 | Larsen et al. | |
| 4,430,541 | A | 2/1984 | Day, Jr. | |
| 4,431,889 | A | 2/1984 | Saponara et al. | |
| 4,477,706 | A | 10/1984 | Mittelsteadt | |
| 5,254,823 | A | 10/1993 | McKee et al. | |
| 5,310,978 | A | 5/1994 | Smith et al. | |
| 5,434,390 | A | 7/1995 | McKee et al. | |
| 5,510,601 | A | 4/1996 | Smith et al. | |
| 5,558,793 | A | 9/1996 | McKee et al. | |
| 5,717,192 | A | 2/1998 | Dobie et al. | |
| 5,927,265 | A | 7/1999 | McKee et al. | |
| 6,005,229 | A | 12/1999 | Brown et al. | |
| 6,058,924 | A | 5/2000 | Pool, III et al. | |
| 6,060,701 | A | 5/2000 | McKee et al. | |
| 6,262,406 | B1 | 7/2001 | McKee et al. | |
| 6,376,817 | B1 * | 4/2002 | McFadden et al. | 219/681 |
| 6,384,381 | B2 | 5/2002 | Witt et al. | |
| 6,472,647 | B2 | 10/2002 | Lee et al. | |

(Continued)

FOREIGN PATENT DOCUMENTS

| | | |
|---|---|---|
| JP | 56044536 | 4/1981 |

*Primary Examiner* — Henry Yuen
*Assistant Examiner* — Thomas Ward
(74) *Attorney, Agent, or Firm* — Diederiks & Whitelaw, PLC

(57) ABSTRACT

A combination cooking appliance controls a radiant heating element provided in an oven cavity, both a blower and a convection heating element provided in an air plenum, and microwave energy sources to provide for numerous potential operating modes. The present invention is particularly concerned with the manner in which the various cooking components are configured and flexibly controlled to provide for short cook cycles in a variety of operational modes.

17 Claims, 3 Drawing Sheets

(56) References Cited

U.S. PATENT DOCUMENTS

| | | | | |
|---|---|---|---|---|
| 6,525,301 | B1 | 2/2003 | Graves et al. | |
| 6,528,772 | B1 | 3/2003 | Graves et al. | |
| 6,872,919 | B2 | 3/2005 | Wakefield et al. | |
| 7,009,147 | B1 | 3/2006 | Schulte | |
| 7,092,988 | B1 * | 8/2006 | Bogatin et al. | 709/203 |
| 7,109,448 | B2 | 9/2006 | Goranson | |
| 7,235,763 | B2 | 6/2007 | Christiaansen et al. | |
| 2003/0146201 | A1 * | 8/2003 | Smith et al. | 219/400 |
| 2006/0157479 | A1 * | 7/2006 | Claesson et al. | 219/681 |
| 2007/0095822 | A1 * | 5/2007 | Wiseman et al. | 219/685 |

* cited by examiner

COOKING APPLIANCE INCLUDING COMBINATION HEATING SYSTEM

CROSS-REFERENCE TO RELATED APPLICATIONS

The present application claims the benefit of U.S. Provisional Patent Application Ser. No. 60/960,660 entitled "Cooking Appliance Including Combination Heating System" filed Oct. 9, 2007.

BACKGROUND OF THE INVENTION

1. Field of the Invention

The present invention pertains to the art of cooking appliances and, more particularly, to a compact cooking appliance capable of combining radiant, convection and microwave heating techniques to perform a cooking operation.

2. Discussion of the Prior Art

There exists a wide range of cooking appliances on the market. Many of these cooking appliances are designed for use in cooking various types of food products in different ways. For instance, where more conventional cooking appliances generally relied upon radiant energy as the sole heat source, more recent trends combine a radiant heat source with convection or microwave heating techniques, thereby increasing the versatility of the cooking appliance while potentially shortening required cook times. In particular, the prior art contains many examples of at least appliances that combine radiant and convection cooking, as well as combination convection and microwave cooking, techniques.

Regardless of the existence of these known arrangements, there still exists a need for a cooking appliance that employ multiple heating techniques in an efficient and effective manner to handle a wide range of food items. Particularly, there exists a need for a cooking appliance that can be used to rapidly prepare food products that require numerous different heat sources for full and complete cooking in an expedited manner. For example, the rapid preparation of commercially produced, open-faced grilled sandwiches raises various cooking concerns. Open-faced grilled sandwiches generally require, at the very least, that heat be directed both downward onto an upper portion of the sandwich and upward onto a lower bun portion of the sandwich. In most cases this is accomplished by passing the open-faced sandwich on a conveyor belt through an oven between opposing radiant heat sources. While effective to a degree, the process can be time consuming and really does not result in a uniform heating of the meat, cheese and/or other toppings on the bread, nor an even toasting of the bread itself.

In addition, a dual radiant oven of the type described above is simply not suitable for many other applications. For instance, an additional microwave oven or the like would typically be employed to heat soup or other liquid-based food items. To address this and other concerns, it has also been proposed in the prior art to combine each of radiant, convection and microwave energy sources in a compact, versatile cooking appliance. Such a prior art arrangement is disclosed, for example, in U.S. Pat. No. 7,235,763.

Regardless of the variety of known cooking appliances, there exists the need for a versatile cooking appliance that combines multiple cooking techniques and enhanced operational features that enable a wide range of food items to be rapidly and effectively cooked. Particularly, there exists a need for a cooking appliance that can establish a synergism between the various heating techniques in order to enhance the overall efficiency and effectiveness of the appliance.

SUMMARY OF THE INVENTION

The present invention is directed to a cooking appliance including an oven cavity having top, bottom and opposing side walls, a door for selectively accessing the oven cavity, a radiant heating element exposed to the oven cavity, a blower having a convection fan, an additional convection heating element directly exposed to an airflow generated by the convection fan and, preferably, multiple microwave heating devices having associated antennae or stirrers. Behind a rear plate of the oven cavity is established an air return plenum for directing a return flow of air from the oven cavity to the blower. The cooking appliance also includes a discharge plenum portion which extends above the oven cavity enabling a convection air stream to flow from the convection fan, across the convection heating element, then through a catalyst and finally into the oven cavity through a plurality of downwardly exposed nozzles. An exhaust tube opens to the discharge air plenum and projects into one end portion of an enlarged, downwardly and rearwardly extending exhaust duct. The air from the exhaust tube merges with a cooling air stream established in the cooking appliance about the oven cavity. More specifically, the cooking appliance includes a cooling fan located behind the air return plenum. The cooling fan draws an ambient air flow into the cooking appliance through air intakes arranged below the oven cavity, while additional fresh intake air directly enters the oven cavity about the door.

The present invention is particularly concerned with configuring the components of the cooking appliance and flexibly controlling those components in a manner which enables short cook cycles in a variety of operational modes. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
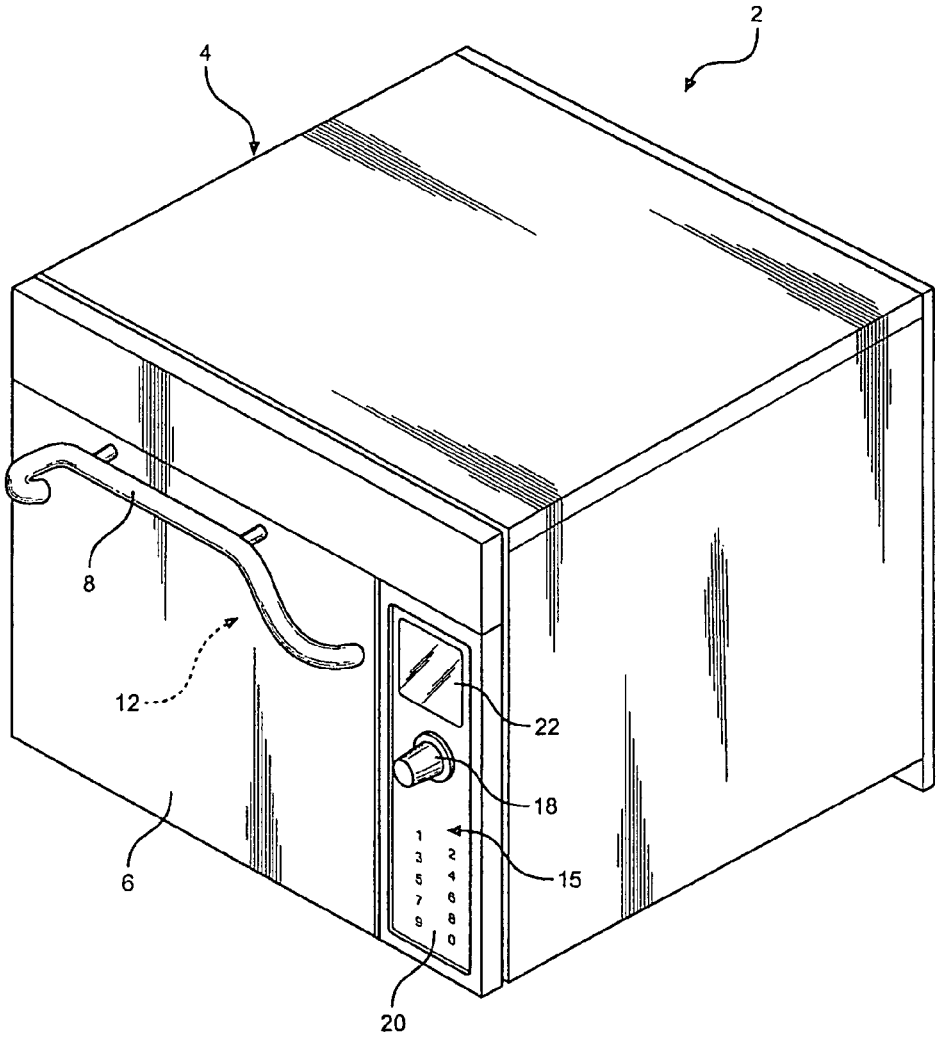
FIG. 1 is an upper right perspective view of a cooking appliance incorporating a combination heating system constructed in accordance with the present invention.

With initial reference to FIG. 1, a cooking appliance constructed in accordance with the present invention is generally indicated at 2. As will be discussed more fully below, cooking appliance 2 constitutes a combination cooking appliance which preferably employs radiant, convection and microwave heating techniques to rapidly and effectively cook a wide range of food items. As shown, cooking appliance 2 includes a cabinet 4 and a door 6 that is provided with a handle 8. In the preferred embodiment shown, door 6 is pivotally mounted about a lower horizontal axis such that handle 8 can be utilized to open door 6 in order to access an internal oven cavity 12. However, a vertical pivoting arrangement, or another type of door opening system, could be readily employed. Cooking appliance 2 also includes a programming interface 15 which is shown to include a control knob 18, a key pad 20 and a touch pad display 22.

Figure 2:
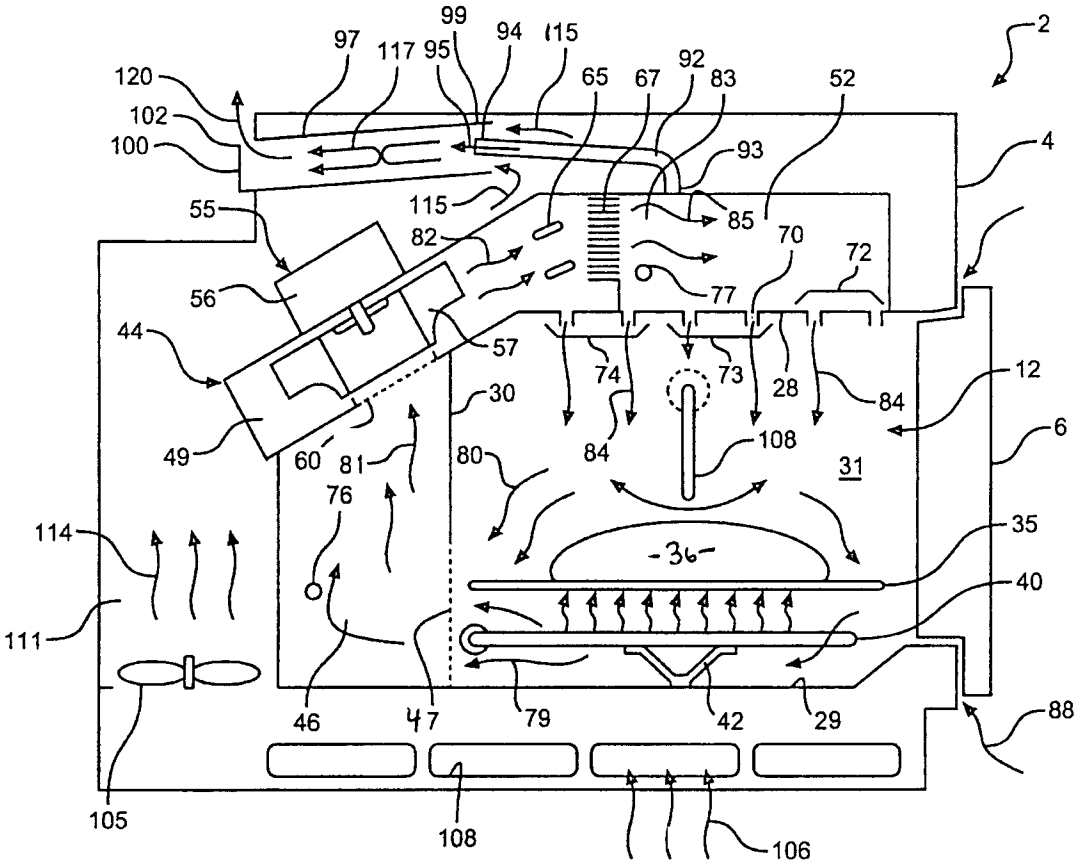
FIG. 2 is a schematic side view of the cooking appliance constructed in accordance with the present invention.

As perhaps best illustrated in the schematic side view of FIG. 2, oven cavity 12 includes top, bottom, rear and opposing side walls 28-31. Mounted within oven cavity 12 is an oven rack 35 which, in the preferred embodiment, constitutes a metal wire rack used to support a food item 36 during cooking. The use of a metal wire rack is desired in order to allow effective air flow around food item 36, while also providing a fairly open support area such that the food item 36 can be radiantly heated from below. As depicted, oven rack 35 is spaced from bottom wall 29 to allow for a sufficient volume of air to flow past the food item 36 such that convection heating can be utilized for both the top and bottom of the food item 36, while also promoting even browning on both the top and bottom. Arranged between oven rack 35 and bottom wall 29 is a radiant heating element 40. More specifically, a support 42 is provided to retain radiant heating element 40 at a substantially intermediate position between bottom wall 29 and oven rack 35. In the most preferred embodiment shown, a single radiant heating element 40 is employed, with radiant heating element 40 being constituted by a sheathed, resistive-type heating element. However, at this point, it should be recognized that multiple radiant heating elements of varying designs can be employed in connection with the invention.

Extending about at least the rear and upper portions of oven cavity 12 is an air plenum 44. More specifically, air plenum 44 includes a return plenum portion 46 which is arranged behind and at least partially defined by rear wall 30. Rear plenum portion 46 has associated therewith an air intake 47 which is defined by a plurality of spaced openings located in rear wall 30 of oven cavity 12. In the most preferred embodiment shown, the plurality of openings extend from above rack 35 to below radiant heating element 40. Air plenum 44 also includes a blower plenum portion 49 and a discharge plenum portion 52. Mounted in blower plenum portion 49 is a blower 55 that includes an electric motor 56 and a fan or impeller unit 57. Blower plenum portion 49 is in fluid communication with return plenum portion 46 through a plurality of openings 60 which leads to a central intake portion of fan unit 57.

Downstream of blower 55, essentially at the juncture of blower plenum portion 49 and discharge plenum portion 52, is a convection heating element 65. Although convection heating element 65 can take various forms, it is preferred to employ a sheathed electric heating unit. Mounted directed adjacent convection heating element 65 is a catalyst unit 67. In a manner known in the art, catalyst unit 67 functions to chemically breakdown airborne byproducts associated with cooking operations. Given the relative position between convection heating element 65 and catalyst unit 67, convection heating element 65 advantageously functions to heat catalyst unit 67 and maintain its temperature at or above a minimum temperature required for proper function of the catalyst.

As clearly shown in these figures, discharge plenum portion 52 is provided with a plurality of nozzles 70 which are spaced along top wall 28 and fluidly interconnect discharge plenum portion 52 with oven cavity 12. In the preferred embodiment shown, the plurality of nozzles 70 are essentially grouped in a first or foremost region 72, a second or intermediate region 73, and a third or aft region 74. As depicted, a portion of the plurality of nozzles 70 located in third region 74 are located prior to catalyst 67, while the remainder of the plurality of nozzles 70 at each of first, second and third regions 72-74 are arranged downstream of catalyst 67. For use in connection with controlling operating temperatures within oven cavity 12, a first temperature sensor 76 is provided within return plenum portion 46 and a second temperature sensor 77 is provided within discharge plenum portion 52. In the most preferred embodiment shown, second temperature sensor 77 is provided directly adjacent catalyst unit 67. As the manner in which heating elements 40 and 65 are controlled to establish and maintain a desired temperature within oven cavity 12 is not part of the present invention, it will not be further discussed herein. Instead, reference is made to copending U.S. patent application entitled "Temperature Control for Cooking Appliance Including Combination Heating System" filed on even date herewith and incorporated herein by reference.

With the above arrangement, operation of blower 55 will create a circulating air flow into and out of oven cavity 12. More specifically, a return flow constituted by a lower flow 79 going below oven rack 35 and an upper flow 80 going over food item 36 will be drawn in to return plenum portion 46 through the plurality of openings 47 of the air intake. This return air, generally indicated at 81, will flow by first temperature sensor 76 and be directed into fan unit 57 through openings 60. Through operation of fan unit 57, the return air flow 81 will be redirected radially outwardly as convection air stream 82. Air stream 82 will be heated upon flowing across convection heating element 65, with a portion of the convection air stream 82 flowing directly into oven cavity 12 at the various nozzles 70 arranged in third region 74 prior to catalyst 67, while a majority of the air flow will flow across catalyst 67 as indicated at 85. The air stream 85 will then flow through the remainder of the plurality of nozzles 70 (see air streams 84) in the first-third regions 72-74 and back into oven cavity 12, with the air flowing around food item 36 prior to the flow cycle being repeated.

In accordance with the most preferred embodiment of the invention, oven cavity 12 is not completely sealed. Instead, during operation of cooking appliance 2, a low pressure is established within oven cavity 12 and a certain amount of ambient air is drawn into oven cavity 12 around door 6, as indicated at 88. In addition to providing a certain amount of fresh air for the cooking operation, the ambient air stream 88 advantageously functions to reduce door temperature. Based on the desire to allow ambient air 88 into oven cavity 12, cooking appliance 2 also employs an exhaust system wherein a small amount of the generally recirculated air is exhausted. More specifically, the exhaust system includes an exhaust tube 92 having a first end 93 opening up into discharge plenum portion 52 and a second end 94 which terminates at a predetermined location within cavity 4. With this arrangement, the recirculated air utilized for cooking has a portion thereof which is lead into exhaust tube 92 so as to define a cooking exhaust stream generally indicated at 95. The overall exhaust system also includes an exhaust mixing tube 97 having a first end 99 which preferably encompasses and yet is radially spaced from second end 94 of exhaust tube 92. That is, first end 99 of exhaust mixing tube 97 preferably has an enlarged diametric dimension relative to second end 94 of exhaust tube 92, with exhaust mixing tube 97 also having associated therewith a second end too having an upwardly opening exit 102.

Also included in connection with cooking appliance 2 is a cooling system arranged within cabinet 4. More specifically, a cooling fan 105 is mounted behind return plenum portion 46. Operation of cooling fan 105 functions to draw a flow of cooling air 106 into cabinet 4, such as through cabinet openings 108. The cooling air 106 is directed by cooling fan 105 through a rear chamber 111 to establish a cooling exhaust stream indicated at 114. Cooling exhaust stream 114 flows about and cools motor 56, as well as various electronic components (not shown), and then around second end 94 of exhaust tube 92 as indicated at 115. This cooling exhaust stream 15 then flows into exhaust mixing tube 97 at first end 99 and mixes with cooking exhaust stream 95 to establish a mixed exhaust stream indicated at 117. Actually, the provision for the cooling air flow creates an elevated pressure in cabinet 4, about oven cavity 12. The cooling exhaust stream 115 flows at a relatively high speed into exhaust mixing tube 97 such that a suction is created which draws cooking exhaust stream 95 into exhaust mixing tube 97. Mixed exhaust stream 117 is then lead through exhaust mixing tube 97 and out upwardly opening exit 102 as a final exhaust 120. Further details of the air flow arrangement can be found in copending U.S. patent application entitled "Air Circuit for Cooking Appliance Including Combination Heating System" filed on even date herewith and incorporated herein by reference.

Figure 3:
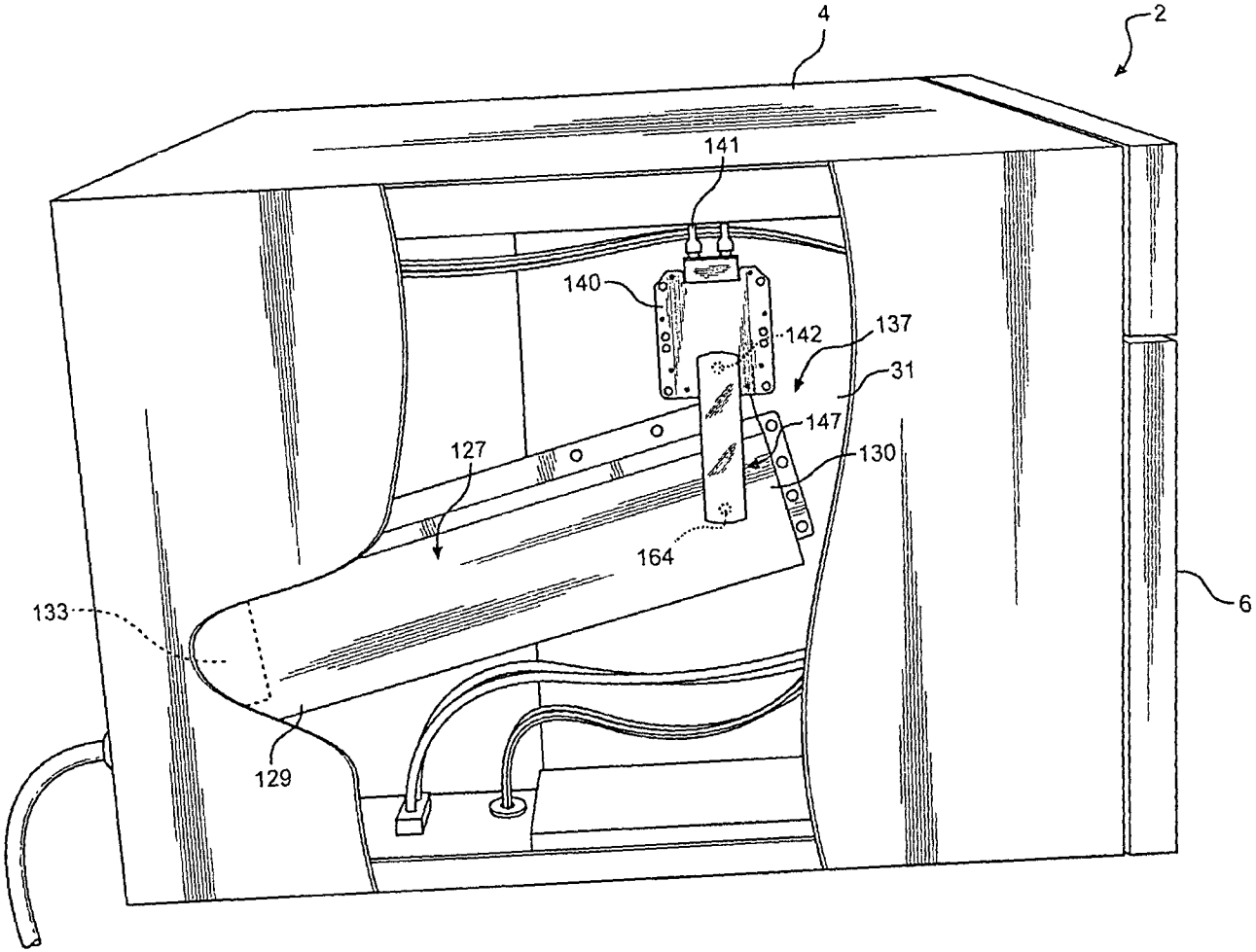
FIG. 3 is a schematic interior side view of the cooking appliance of FIGS. 1 and 2.

With the arrangement discussed above, cooking appliance 2 can be employed to cook food items utilizing both radiant and convection cooking techniques. However, it is also desired to further incorporate microwave cooking techniques. To this end, as best shown in FIG. 3, cooking appliance 2 is also provided with a pair of wave guides mounted along opposing side walls 31, with one of the waveguides being indicated at 127. Basically, the arrangement on each side of oven cavity 12 is preferably, identically constructed such that reference will be made in detailing one side arrangement. In any case, in connection with the microwave system employed, waveguide 127 includes a first end portion 129 and a second end portion 130. Generically indicated at 133 is a magnetron for generating microwaves which propagate through waveguide 127 and are lead into oven cavity 12. At second end portion 130 is provided a stirrer assembly generally indicated at 137. In the preferred embodiment shown, stirrer assembly 137 includes a motor housing 140 to which is applied electric current through wires 141. Motor housing 140 has associated therewith a rotatable output shaft 142 linked to a mechanism 147 for transferring the rotation of output shaft 142 to a drive member 164. Drive member 164 is fixed for rotation to a rotatable antenna or stirrer 168 (see FIG. 2) which is mounted behind a respective side wall 31. Most preferably, each antenna 168 oscillates, rather than rotating through 360° during operation in order to more evenly distribute the microwave energy, particularly at the height of oven rack 35. Further details of the microwave supply and distribution arrangement can be found in copending U.S. patent application entitled "Combination Cooking Appliance Including Multiple Microwave Heating Units With Rotatable Antennae" filed on even date herewith and incorporated herein by reference. In any case, in the most preferred embodiment, the overall microwave system is designed to introduce microwaves from both of opposing side walls 31 at a position close to top wall 28. This arrangement is considered to at least facilitate the use of metal pans by introducing the microwave energy into the oven cavity at a position wherein the metal pans will not block the microwave energy from reaching the food load. In any case, the stirrers 168 provided on side walls 131 further enhance the distribution of the microwaves for oven cavity 12.

With the above construction, cooking appliance 2 can operate in various modes including: microwave only mode; bake mode; combination bake and convection mode; and full combination mode with microwave, radiant, and hot air convection for high speed food cooking. With this in mind, the present invention is particularly concerned with the construction and relative arrangement of certain components as described above and the manner in which cooking appliance 2 operates in the various modes as detailed below. In connection with each of the modes, it is assumed that a user has placed food item 36 in oven cavity 12, either directly on oven rack 35 or in a pan (not shown) placed on oven rack 35, closed door 6 and selected a desired cooking operation through interface 15.

Microwave Only Mode

Based on the configuration of waveguides 127, the generated microwaves are introduced into oven cavity 12 at a high position from both sides, while antennae 168 are oscillated. Introducing the microwaves from above food item 36, thereby enhancing the use of metal pans and minimizing the potential to have microwave energy blocked by use of a pan. In this mode, radiant heating element 40 is disabled. Developed moisture is advantageously able to escape from oven cavity 12. More specifically, fan unit 57 is operated in the microwave only mode in order to increase the pressure at nozzles 70, thereby increasing the exhaust rate and, correspondingly, enhancing the escape of moisture. With the operation of fan unit 57, the relatively small exhaust tube 92, which is also employed in heated convection modes, can still be used to control condensation in oven cavity 12 in the microwave only mode.

Bake Mode

Oven cavity 12 can be used in a more conventional baking mode with the operation of radiant heating element 35. In general, the operating range is generally in the order of 250°-450° F., although the temperature may not be limited to this range. Venting through nozzles 70, exhaust tube 92 and mixing tube 97 is offset by incoming ambient air 88. Interface 15 allows the user to adjust desired power settings to automatic vary during stages of cooking.

Combination Bake and Convection Mode

Standard for this mode is the use of radiant heating element 40, blower 55, convection heating element 65 and catalyst 67. As with the bake mode, the operating temperature range is essentially in the range of, but limited to, 250°-450° F. and sheathed radiant heating element 40 is the primary heat source. However, blower 55 is operated at a low speed to create a minimal pressure rise in discharge plenum portion 52. With the existence of exhaust tube 52 and the operation of blower 55, a less than atmospheric pressure cooking condition is created in oven cavity 12. This negative cavity pressure facilitates ambient make-up air 88 to enter about door 6. The controls associated with interface 15 enable power settings of various components, including heating element 40, blower 55 and heating element 65, to be programmed to automatically vary during a given cooking cycle, thereby permitting the user to tailor the cooking cycle to a particular food item. In addition, the user, in this mode, can configure cooking appliance 2 to activate generator(s) 133 such that a combination of microwave, radiant heat in bottom of the oven cavity, and low speed convection air resulting in minimal pressure rise in air discharge plenum can be established.

Full Combination Mode

In this operational mode, cooking appliance 2 can perform a cooking operation using a combination of microwave, radiant heat and high speed convection air, or any combinations thereof. The operating temperature is in the range of, but limited to, 450°-525° F., a significant leap from the other modes. In this mode, radiant heating element 40 is preferably controlled separately from convection heating element 65, with the operation of radiant heating element 40 being dependent on temperature signals from temperature sensor 76 and convection heating element 65 operating based on signals from temperature sensor 77 versus a desired set point temperature which is preferably established by the user. Microwave power can be adjusted from 0-100%. The actual flow rate of high speed impingement air 84 can be adjusted at blower 55 to achieve desired cooking results. In any case, the heated, high speed flow provides for accelerated heat transfer and enhances the browning on top of food item 36. Similarly, the power to radiant heating element 40 can be varied to provide radiant heat and browning from below oven rack 35. At the same time, heating element 40 heats upper and lower air flows 79 and 80 as the air passes around food item 36, before entering return plenum portion 47 through air intake 47.

The temperature in oven cavity 12 is generally maintained with a combination of radiant heating element 40 and air stream 84 entering oven cavity 12 after being heated by both radiant heating element 40 and convection heating element 65. At the same time, the operation of convection heating element 65 maintains catalyst 67 in an activated state to remove airborne byproducts from the passing air stream 82. The controls associated with interface 15 enable power settings of various components, including heating element 40, blower 55 and heating element 65, as well as the development of microwaves through microwave generators 133, to be programmed to automatically vary during a given cooking cycle, thereby permitting the user to tailor the cooking cycle to a particular food item. In a manner corresponding to that discussed above, vent and make-up air allow for moisture to escape the overall system. In addition, the preferred vent location of high pressure, air discharge plenum 52 allows oven cavity 12 to be operated at less than atmospheric pressure when blower 55 is operating, facilitating negative cavity pressure and make up air 88 entering at door 6.

Based on the above, it should be readily apparent that the overall construction and control of cooking appliance 2 provides for a variety of available cooking modes which can be tailored to particular user preferences. The various heating and air flow system components synergistically combine to provide an overall cooking configuration that is versatile, efficient and effective for a wide range of cooking applications ranging from a slow cook and browning operation to high speed, short cook to time cycles in a variety of operational modes employing multiple cooking techniques operating in unison. Although described with reference to a preferred embodiment of the invention, it should be recognized that various changes and/or modification could be made to the invention without departing from the spirit thereof. In general, the invention is only intended to be limited by the scope of the following claims.

We claim:

1. A cooking appliance for cooking food items using multiple cooking techniques comprising:

a cabinet;

an oven cavity arranged in the cabinet, said oven cavity including top, bottom, rear and opposing side walls;

an oven rack supported in the oven cavity, said oven rack being spaced from the bottom wall of the oven cavity;

a radiant heating element positioned between the oven rack and the bottom wall of the oven cavity;

a microwave cooking system for generating microwaves which are introduced into the oven cavity from at least one of the opposing side walls, close to the top wall, for selectively performing a portion of a cooking operation;

an airflow delivery system including:

an air intake including a plurality of openings located in the rear wall of the oven cavity behind the oven rack, wherein the air intake extends both above and below the oven rack, as well as both above and below the radiant heating element;

an air plenum including a return plenum portion exposed to the air intake, a blower plenum portion, and a discharge plenum portion extending over the oven cavity;

a blower including a fan unit located in the blower plenum portion and adapted to draw an air stream from the return plenum portion and direct the air stream into the discharge plenum portion;

a catalyst positioned in the discharge plenum portion for removing airborne particles from the air stream;

a convection heating element interposed between the fan unit and the catalyst; and a plurality of discharge nozzles leading into the oven cavity from the discharge plenum portion for directing the air stream toward the oven rack; and a user interface for programming the cooking appliance for operating in each of a microwave only mode, a bake mode, a combination bake and convection mode and a full combination mode with microwave, radiant and hot air convection for high speed food cooking.

2. The cooking appliance according to claim 1, wherein the plurality of openings extend from above the oven rack to below the radiant heating element.

3. The cooking appliance according to claim 1, wherein the convection heating element is located at a juncture between the blower plenum portion and the discharge plenum portion.

4. The cooking appliance according to claim 3, wherein the catalyst is located directly adjacent the convection heating element.

5. The cooking appliance according to claim 1, wherein the blower plenum portion is arranged downstream of the return plenum portion and substantially entirely behind the rear wall of the oven cavity.

6. The cooking appliance according to claim 5, wherein the blower plenum portion is located above both the return plenum portion and the plurality of openings.

7. The cooking appliance according to claim 6, wherein substantially the entire blower plenum portion is located rearward of the air intake.

8. The cooking appliance according to claim 1 wherein, during the microwave only mode, the radiant heating element is not activated, while both the microwave cooking system and the blower are activated, with the blower being maintained at a low operating speed.

9. The cooking appliance according to claim 1 wherein, during the full combination mode, the radiant heating element, the blower, the convection heating element and the microwave cooking system are activated, with at least a power for the microwave cooking system and a speed of the blower being adjustable.

10. The cooking appliance according to claim 9 wherein, during the full combination mode, the radiant heating element is independently controlled from the convection heating element.

11. The cooking appliance according to claim 1 wherein, during each of the bake mode and the combination bake and convection mode, an operating temperature range in the order of 250°-450° F. is established for the oven cavity while, in the full combination mode, an operating temperature range is in the order of 450°-525° F. is established.

12. In a cooking appliance including a cabinet having an internal oven cavity adapted to be closed by a door, and having an oven rack adapted to support food to be cooked and selectively heated by microwave, radiant and convection heating systems including separate radiant and convection heating elements, a method of operating the cooking appliance comprising:

establishing a microwave only mode in which the radiant heating element is not activated, while both the microwave and convection heating systems are activated, with the convection heating system being operated on a low speed;

establishing a combination bake and convection mode in which the radiant heating element and the convection heating system are activated, while an operating temperature range in the order of 250°-450° F. is established for the oven cavity; and establishing a full combination mode in which each of the radiant heating element, the microwave heating system and the convection heating system is activated, while an operating temperature range in the order of 450°-525° F. is established for the oven cavity, wherein, whenever the convection heating system is operated air is drawn through an air intake which extends both above and below the oven rack, as well as both above and below the radiant heating element.

13. The method of claim 12, wherein the convection heating system includes a blower and, in the microwave only mode, the blower is activated to remove moisture from within the oven cavity.

14. The method of claim 12 wherein, whenever the microwave heating system is activated, microwaves are introduced into the oven cavity from opposing side walls, close to a top wall, of the oven cavity.

15. In a cooking appliance cooking appliance for cooking food items using multiple cooking techniques including: a cabinet; an oven cavity arranged in the cabinet, said oven cavity including top, bottom, rear and opposing side walls; an oven rack supported in the oven cavity, said oven rack being spaced from the bottom wall of the oven cavity; a radiant heating element positioned between the oven rack and the bottom wall of the oven cavity; a microwave cooking system for generating microwaves which are introduced into the oven cavity from at least one of the opposing side walls, close to the top wall; an airflow delivery system having: an air intake including a plurality of openings located in the rear wall of the oven cavity behind the oven rack; an air plenum including a return plenum portion exposed to the air intake, a blower plenum portion, and a discharge plenum portion extending over the oven cavity; a blower including a fan unit located in the blower plenum portion and adapted to draw an air stream from the return plenum portion and direct the air stream into the discharge plenum portion; a catalyst positioned in the discharge plenum portion for removing airborne particles from the air stream; a convection heating element interposed between the fan unit and the catalyst; and a plurality of discharge nozzles leading into the oven cavity from the discharge plenum portion for directing the air stream toward the oven rack; and a user interface for programming the cooking appliance for operating in each of a microwave only mode, a bake mode, a combination bake and convection mode and a full combination mode with microwave, radiant and hot air convection for high speed food cooking, a method of operating the cooking appliance comprising:

establishing a microwave only mode in which the radiant heating element is not activated, while both the microwave and convection heating systems are activated, with the convection heating system being operated on a low speed;

establishing a combination bake and convection mode in which the radiant heating element and the convection heating system and activated, while an operating temperature range in the order of 250°-450° F. is established for the oven cavity; and establishing a full combination mode in which each of the radiant heating element, the microwave heating system and the convection heating system is activated, while an operating temperature range in the order of 450°-525° F. is established for the oven cavity, wherein, whenever the convection heating system is operated, air is drawn through an air intake which extends both above and below the oven rack, as well as both above and below the radiant heating element.

16. The method of claim 15, wherein the convection heating system includes a blower and, in the microwave only mode, the blower is activated to remove moisture from within the oven cavity.

17. The method of claim 15 wherein, whenever the microwave heating system is activated, microwaves are introduced into the oven cavity from opposing side walls, close to a top wall, of the oven cavity.

* * * * *